United States Patent [19]

Teague

[11] 4,426,927

[45] Jan. 24, 1984

[54] COMPRESSED WASTE HOLDDOWN

[75] Inventor: Lyndon M. Teague, Wilmington, N.C.

[73] Assignee: Container Products Corporation, Wilmington, N.C.

[21] Appl. No.: 383,531

[22] Filed: Jun. 1, 1982

[51] Int. Cl.[3] ..... B30B 15/06

[52] U.S. Cl. ..... 100/219; 100/245; 100/295

[58] Field of Search ..... 100/219, 220, 240, 245, 100/274, 295

[56] References Cited

U.S. PATENT DOCUMENTS

| | | | |
|---|---|---|---|
| 30,500 | 10/1860 | Randel | 100/219 |
| 715,065 | 12/1902 | Helgeson | 100/219 |
| 3,826,186 | 7/1974 | Mechler | 100/219 X |
| 4,182,236 | 1/1980 | Greer | 100/220 X |

*Primary Examiner*—Billy J. Wilhite
*Assistant Examiner*—Christine A. Peterson
*Attorney, Agent, or Firm*—Edward C. Threedy

[57] ABSTRACT

A device for use with waste containers wherein the waste is packed, compressed and held in its compact state within the container until the container's capacity is reached. The device comprises a frame consisting of a pair of cross bars with the opposite ends of certain of the cross bars received in vertical channels carried by confronting interior wall surfaces of the wall container. The channels are provided with yieldable locking members projecting inwardly of the channels and adapted to retain the cross bars in a depressed position against the compacted waste material within the container.

4 Claims, 5 Drawing Figures

23
20
22
21
19
24
25
15
16
12
18
17
11
13

COMPRESSED WASTE HOLDDOWN

SUMMARY OF THE INVENTION

In the art of disposing of waste material the use of compactors is employed. These compactors normally compress and compact waste within a container with the container being sealed, and, in some instances, disposed along with the waste.

In commercial establishments the cost of disposing of waste is measured by the cubic foot, and it therefore becomes necessary to assure that the containers are as fully packed with compressed waste material as possible. It is the purpose of this invention to achieve that purpose.

In disposing of waste it is the normal practice that the waste be placed in a disposable bag, usually composed from a vinyl or plastic material. This material has an inherent memory causing it to return to its initial condition after it has been compressed. Thus, the inherent memory of the bagged material together with such inherent memory as may be possessed by the waste material itself causes an expansion of the same within the waste container creating a false fullness. It is the purpose of this invention to maintain such material in a compacted compressed state within the container.

The device consists of a frame constructed from a pair of cross bars having the dimensions to fit within the interior of a waste container. Certain opposite interior wall surfaces of the container are provided with vertical channels which will receive corresponding opposite ends of certain of the cross bars of the frame. Each channel member provides a set of horizontally aligned yieldable retaining members over which the ends of the cross bars can be forced in one direction but with said restraining members resisting movement of the ends of the cross bars in an opposite direction.

An object of this invention is to provide a simple compressed waste holddown which is simple in construction and economical to manufacture.

Other objects of the invention will appear hereinafter.

BRIEF DESCRIPTION OF THE DRAWINGS

The invention will be best understood by reference to the accompanying drawings which disclose the preferred mode of construction by which the stated objects of the invention are achieved, and in which.

GENERAL DESCRIPTION

Figures 1, 2, 3, 4, 5:
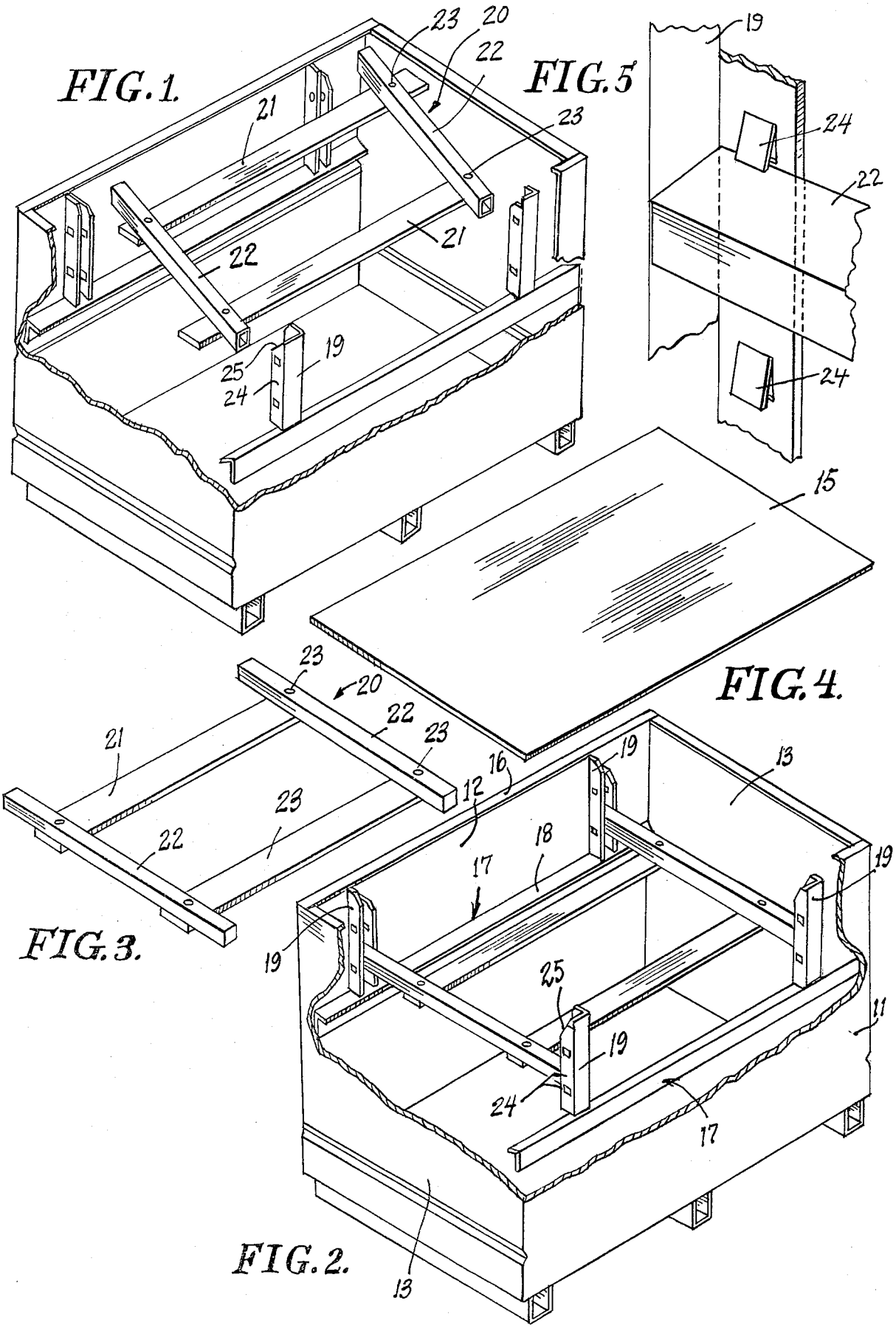
FIG. 1 is a fragmentary perspective view of a waste container showing the waste holddown positioned therein in operative condition.
FIG. 2 is a perspective view of the waste holddown.
FIG. 3 is a fragmentary perspective view of the waste holddown in its swivelled position for placement within the waste container.
FIG. 4 is a fragmentary perspective view of the waste containers' lid.
FIG. 5 is a fragmentary enlarged view showing the waste holddown restraining members.

Referring to FIG. 1 of the drawings there is shown an open top waste container 10 consisting of a front wall 11, back wall 12, side walls 13, and a bottom wall 14.

A closure or lid 15 is adapted to sit upon inturned flanges 16 provided by the upper free edges of the front wall 11, back wall 12, and side walls 13.

Attached to the interior wall surfaces of the front wall 11 and back wall 12 are horizontally aligned elongated rails 17, each of which provides an inwardly directed base flange 18. Extending vertically from each of the base flanges 18 and attached to the interior wall surfaces of the front wall 11 and rear wall 12 are sets of vertically extending horizontally aligned U-shaped channels 19.

As shown in FIG. 2 there is provided a holddown 20 which consists of a frame including a pair of waste engaging retaining plates 21. Attached to the waste retaining plates 21 is a pair of cross bars 22. These cross bars 22 are loosely connected to the plates 21 by any suitable connectors, such as bolts 23 and the like, which permits the plates and cross bars to be swivelled from its position as shown in FIG. 1 to that as shown in FIG. 3.

The retaining plates 21 are of a length less than that of the container 10, while the cross bars 22 are of a length to have their opposite ends projected into correspondingly aligned channels 19, as shown in FIG. 1. Therefore, in order to be placed within the container 10 the frame 20 must have the cross bars 22 swivelled relative to the retaining plates 21, so that the ends of the cross bars 22 will pass within the inturned flanges 16 provided by the upper exposed edge of the container 10.

To cooperate with swivel action of the frame 20, certain opposite ends of each of the channels 19 will have a portion of one of its arms 24 removed, as at 25, so that the ends of the cross bars 22 may be moved therethrough into the channels 19.

The container 10 is placed in a waste compactor after it has been loosely filled with waste material. The waste holddown 20 is then placed in the channels 19 so that it may be forced downwardly through the channels 19 by the action of the compactor. In this downward movement the free ends of the cross bars 22 will be forced to pass beneath the yieldable retaining members 26 provided by the opposite arms of the U-shaped channel 19, as viewed in FIG. 4. These retaining members 26 are three-sided lugs 27 struck from the body 28 of the arms of the U-shaped channel 19, and projected into the open area of the channels as shown.

When the compressing action of the compactor is relieved, the waste holddown 20 will prevent the expansion of the compressed or compacted waste material thereby making available more area for the reception of additional waste material.

From the foregoing it is apparent that through the use of the compact waste holddown the functional volume of the container is maximized.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described the invention, what I claim as new and desire to protect by Letters Patent is:

1. A compressed waste holddown including an open top disposable waste container in which waste is placed and compressed by a waste compactor comprising;

(a) a removable waste holddown means including a normally square shaped frame having a pair of parallelly extending waste retaining plates and a pair of cross bars connected thereto, (b) means for pivotally connecting said cross bars to said plates whereby said frame may be collapsed out of its normal square shape for free insertion through the open top of the container, (c) guide means provided by the container for guiding said waste holddown means whereby it may be moved vertically through the interior of the container by the waste compactor during the compacting of the disposable waste placed therein, (d) means provided by said holddown means cooperating with said guide means for guiding its movement through the container, and (e) means for retaining said waste holddown means in a depressed position upon the disposable waste compressed in the container by the waste compactor.

2. A compressed waste holddown as defined by claim 1, wherein said guiding means comprise sets of U-shaped channels on the interior opposite wall surfaces of the container with said channels opening inwardly and providing guides for the ends of said pair of cross bars when said waste holddown frame is within the container and in its normally square condition.

3. A compressed waste holddown as defined by claim 1 wherein said means for retaining said waste holddown means in a depressed position comprises yieldable lugs struck from opposite arms of said guide means with said lugs extending in a downward direction and engageable with certain portions of said holddown means so as to prevent vertical movement of said means through said channels.

4. A compressed waste holddown as define by claim 3 wherein said guiding means comprise sets of U-shaped channels on the interior opposite wall surfaces of the container with said channels opening inwardly and providing guides for the ends of said pair of cross bars when said waste holddown frame is within the container and in its normally square condition.

* * * * *